US010905161B2

(12) United States Patent
Chen

(10) Patent No.: US 10,905,161 B2
(45) Date of Patent: Feb. 2, 2021

(54) ELECTRONIC CIGARETTE AND BILAYER TOBACCO LIQUID STORING STRUCTURE

(71) Applicant: SHENZHEN IVPS TECHNOLOGY CO., LTD., Shenzhen (CN)

(72) Inventor: Wen Chen, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 361 days.

(21) Appl. No.: 15/881,764

(22) Filed: Jan. 27, 2018

(65) Prior Publication Data

US 2018/0146707 A1 May 31, 2018

(30) Foreign Application Priority Data

Nov. 28, 2016 (CN) ..... 2016 2 1286944 U

(51) Int. Cl.
*A24F 47/00* (2020.01)
*A24F 40/30* (2020.01)
*A24F 40/42* (2020.01)

(52) U.S. Cl.
CPC ..... *A24F 47/002* (2013.01); *A24F 40/30* (2020.01); *A24F 40/42* (2020.01)

(58) Field of Classification Search
CPC ..... A24F 40/30
See application file for complete search history.

(56) References Cited

U.S. PATENT DOCUMENTS

2014/0360514 A1 12/2014 Zhu
2018/0184714 A1* 7/2018 Liu ..... A61M 15/06

FOREIGN PATENT DOCUMENTS

CN 203353681 U 12/2013
CN 104082863 A 10/2014
CN 204048043 U 12/2014
CN 105747282 A 7/2016

* cited by examiner

*Primary Examiner* — Michael H. Wilson
*Assistant Examiner* — Katherine A Will
(74) *Attorney, Agent, or Firm* — IP-PAL Patent US; Klaus Michael Schmid

(57) ABSTRACT

The present disclosure provides an electronic cigarette and a bilayer tobacco liquid storing structure thereof. The bilayer tobacco liquid storing structure includes an upper cover assembly, a lower cover assembly, a liquid-flow regulating assembly, a first liquid storage chamber and a second liquid storage chamber. The upper cover assembly is configured to be connected to one end of the first liquid storage chamber. The liquid-flow regulating assembly has two ends connected to the first liquid storage chamber and the second liquid storage chamber respectively. The lower cover assembly is configured to be connected to the second liquid storage chamber. The liquid-flow regulating assembly is configured to enable the communication between the first liquid storage chamber and the second liquid storage chamber. The electronic cigarette according to the present disclosure makes full use of the internal space and thus enlarges the liquid storage space and improves user experience.

9 Claims, 4 Drawing Sheets

ELECTRONIC CIGARETTE AND BILAYER TOBACCO LIQUID STORING STRUCTURE

CROSS REFERENCE TO RELATED APPLICATIONS

The present application claims priority to Chinese Patent Application CN 201621286944.0 filed on Nov. 28, 2016.

TECHNICAL FIELD

The present disclosure relates to the technical field of electronic cigarettes, and in particular to an electronic cigarette and a bilayer tobacco liquid storing structure thereof.

BACKGROUND

As people raise concern about health, they become aware of the harm caused by tobaccos to bodies. Thus, electronic cigarettes appear accordingly. The electronic cigarette generally aerosolizes a tobacco liquid through an atomizer to generate an aerosol for a user to inhale. During the production process of the tobacco liquid, harmful substances such as nicotine and tar are removed; thus, hazards to human bodies are eliminated. Because the tobacco liquid contains no harmful substances such as nicotine and tar, people's addiction to tobacco smoking is gradually reduced after they smoke electronic cigarettes. Therefore, electronic cigarettes can help quit tobacco smoking. Current electronic cigarette products normally have a single-layer liquid storage structure, have a lower cover occupying a big space, and have a small liquid storage space.

SUMMARY

The present disclosure mainly aims to provide an electronic cigarette and a bilayer tobacco liquid storing structure thereof, so as to optimize the internal liquid-storage space of the electronic cigarette and improve user experience.

In order to achieve the above aim, the bilayer tobacco liquid storing structure provided by the present disclosure includes an upper cover assembly, a lower cover assembly, a liquid-flow regulating assembly, a first liquid storage chamber and a second liquid storage chamber. The upper cover assembly is configured to be connected to one end of the first liquid storage chamber. The liquid-flow regulating assembly has two ends connected to the first liquid storage chamber and the second liquid storage chamber respectively. The lower cover assembly is configured to be connected to the second liquid storage chamber. The liquid-flow regulating assembly is configured to enable the communication between the first liquid storage chamber and the second liquid storage chamber.

Preferably, the liquid-flow regulating assembly includes a threaded ring, an internal thread and a liquid-flow regulating ring. The threaded ring is configured to be matched and connected with the internal thread so as to secure the liquid-flow regulating ring between the threaded ring and the internal thread.

Preferably, the liquid-flow regulating ring defines two first through holes, the two first through holes being distributed symmetrically along a central axis of the liquid-flow regulating ring; and the internal thread and the threaded ring define a second through hole fitting the first through hole.

Preferably, the liquid-flow regulating assembly further includes a pin; and the pin is configured to be installed at a position close to the first through hole.

Preferably, the second liquid storage chamber includes a support and a second casing; the support is configured to be connected to the internal thread; and the second casing is configured to be sleeved on the support.

Preferably, the liquid-flow regulating assembly further includes a sealing ring; and the sealing ring is configured to be installed between the liquid-flow regulating ring and the internal thread.

Preferably, the upper cover assembly includes a mouthpiece, an upper cover and a fixing part; the upper cover is configured to be connected to the fixing part; the mouthpiece is configured to be in thread connection with the upper cover; and the fixing part defines two first air inlets, the two first air inlets being distributed symmetrically along a central axis of the fixing part.

Preferably, the upper cover assembly further includes an airflow regulating ring; the airflow regulating ring has an outer circumferential surface defining two second air inlets, the two second air inlets being distributed symmetrically along a central axis of the airflow regulating ring; and the airflow regulating ring is configured to be sleeved on the fixing part.

Preferably, the first liquid storage chamber includes an atomizer assembly and a first casing; the atomizer assembly has one end connected to the internal thread and the other end connected to the fixing part; and the first casing is configured to be sleeved on the atomizer assembly.

The present disclosure further provides an electronic cigarette. The electronic cigarette includes the bilayer tobacco liquid storing structures as described in any one of the above.

In the technical scheme of the present disclosure, the bilayer tobacco liquid storing structure includes an upper cover assembly, a lower cover assembly, a liquid-flow regulating assembly, a first liquid storage chamber and a second liquid storage chamber. The upper cover assembly is configured to be connected to one end of the first liquid storage chamber. The liquid-flow regulating assembly has two ends connected to the first liquid storage chamber and the second liquid storage chamber respectively. The lower cover assembly is configured to be connected to the second liquid storage chamber. The liquid-flow regulating assembly is configured to enable the communication between the first liquid storage chamber and the second liquid storage chamber. The electronic cigarette according to the present disclosure makes full use of the internal space and thus enlarges the liquid storage space and improves user experience.

BRIEF DESCRIPTION OF THE DRAWINGS

For a better understanding of the technical scheme in the embodiments of the present disclosure or in the prior art, accompanying drawings needed in the description of the embodiments or the prior art are simply illustrated below. Obviously, the accompanying drawings described below are some embodiments of the present disclosure. For the ordinary skill in the field, other accompanying drawings may be obtained according to the structure shown in these accompanying drawings without creative work.

DESCRIPTION OF REFERENCE NUMBERS

Figure 1:
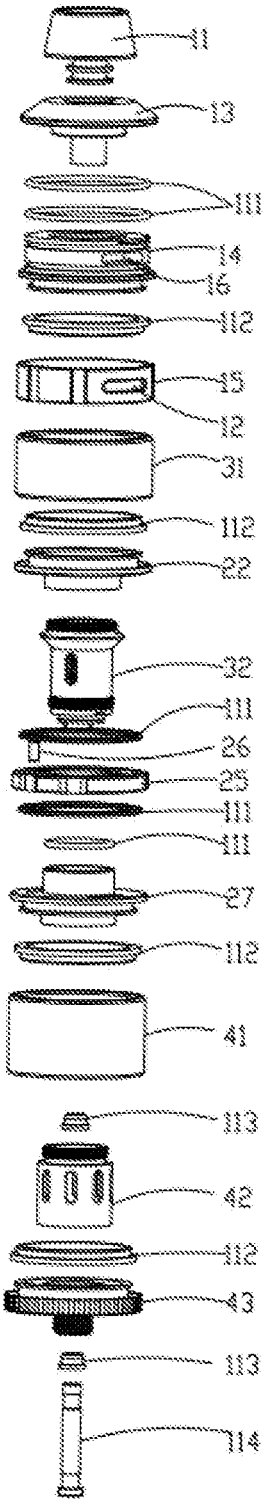
FIG. 1 is an exploded view of a bilayer tobacco liquid storing structure for an electronic cigarette according to an embodiment of the present disclosure.
Figure 2:
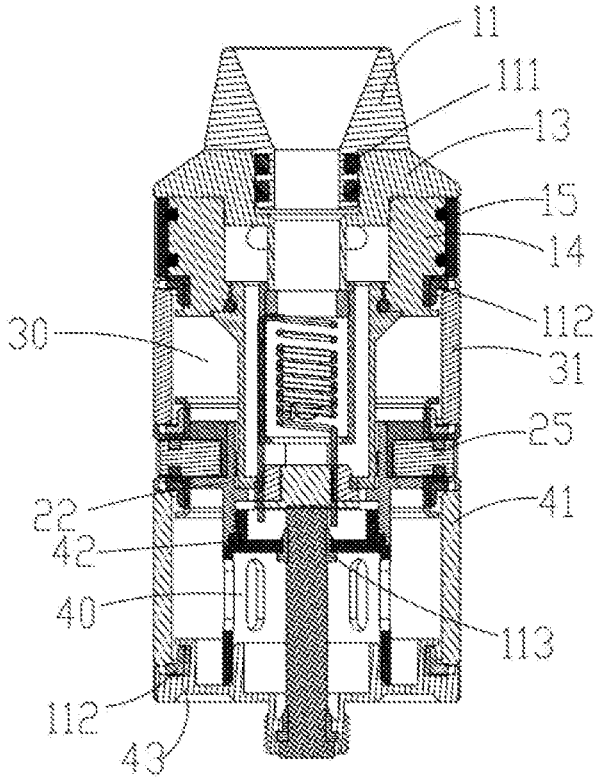
FIG. 2 is a cross-sectional view of a bilayer tobacco liquid storing structure for an electronic cigarette according to an embodiment of the present disclosure.
Figure 3:
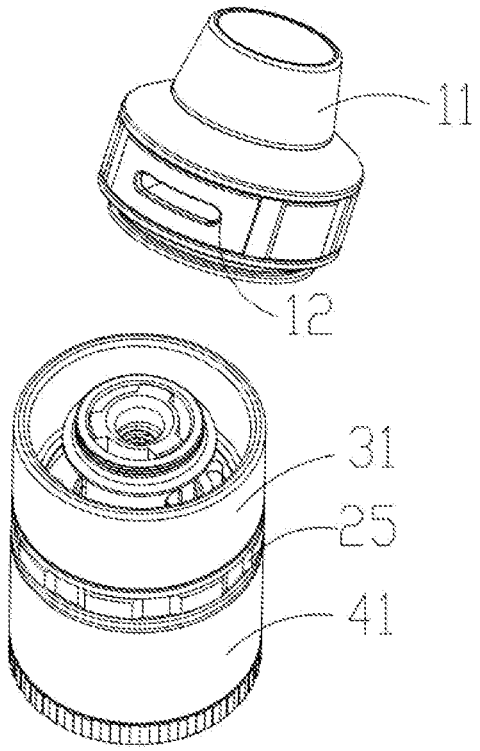
FIG. 3 is a diagram of a bilayer tobacco liquid storing structure for an electronic cigarette according to an embodiment of the present disclosure.

| Reference number | Name of Part | Reference number | Name of Part |
|---|---|---|---|
| 11 | Mouthpiece | 31 | First casing |
| 12 | First air inlet | 32 | Atomizer assembly |
| 13 | Upper cover | 41 | Second casing |
| 14 | Fixing part | 42 | Support |
| 15 | Airflow regulating ring | 43 | Lower cover |
| 16 | Second air inlet | 111 | Sealing ring |
| 20 | Liquid-flow regulating assembly | 112 | Flat washer |
| 21 | Second through hole | 113 | Insulating ring |
| 22 | Threaded ring | 114 | Contact part |
| 24 | First through hole | 30 | First liquid storage chamber |
| 25 | Liquid-flow regulating ring | 40 | Second liquid storage chamber |
| 26 | Pin | 27 | Internal thread |

The implementation of aims, the function features and the advantages of the present disclosure are described below in further detail in conjunction with embodiments with reference to the drawings.

DETAILED DESCRIPTION

A clear and complete description as below is provided for the technical scheme in the embodiments of the present disclosure in conjunction with the drawings in the embodiments of the present disclosure. Obviously, the embodiments described hereinafter are simply part embodiments of the present disclosure, but all the embodiments. All other embodiments obtained by the ordinary skill in the art based on the embodiments in the present disclosure without creative work are intended to be included in the scope of protection of the present disclosure.

It should be noted that all directional indications (such as top, bottom, left, right, front, behind, etc.) in the embodiments of the present disclosure are merely to illustrate a relative position relation, a relative motion condition, etc. between each part in a certain state (for example, the state shown in the drawings). If the state changes, the directional indication changes accordingly.

In addition, if terms "first", "second", etc. appear in the present disclosure, they are merely for the purpose of description, but cannot be understood as the indication or implication of relative importance or as the implicit indication of the number of the designated technical features; therefore, features defined by "first" and "second" may specifically or implicitly include at least one such feature. In the description of the present disclosure, unless otherwise stated, "a plurality of" means at least two, for example, two, three, etc.

In the present disclosure, unless otherwise specifically stated and defined, terms "connected", "fixed", etc. should be interpreted expansively. For example, "fixed" may be fixed connection, also may be detachable connection, or integration; may be mechanical connection, also may be electrical connection; may be direct connection, also may be indirect connection through an intermediate, and may be internal communication between two elements or interaction of two elements, unless otherwise specifically defined. The ordinary skill in this field can understand the specific implication of the above terms in the present disclosure according to specific conditions.

In addition, technical schemes of each embodiment of the present disclosure may be combined mutually; however, this must be conducted on the basis that the ordinary skill in this field can implement the combination. When the combination of technical schemes has a conflict or cannot be implemented, it should be considered that such combination of technical schemes does not exist and is not in the scope of protection claimed by the present disclosure.

The present disclosure provides a bilayer tobacco liquid storing structure for an electronic cigarette.

Referring to FIG. 1 to FIG. 6, in an embodiment of the present disclosure, the bilayer tobacco liquid storing structure includes an upper cover assembly (not marked in the drawings), a lower cover assembly (not marked in the drawings), a liquid-flow regulating assembly 20, a first liquid storage chamber 30 and a second liquid storage chamber 40. The upper cover assembly is configured to be connected to one end of the first liquid storage chamber 30. The liquid-flow regulating assembly 20 has two ends connected to the first liquid storage chamber 30 and the second liquid storage chamber 40 respectively. The lower cover assembly is configured to be connected to the second liquid storage chamber. The liquid-flow regulating assembly 20 is configured to enable the communication between the first liquid storage chamber 30 and the second liquid storage chamber 40. In particular, one end of the electronic cigarette normally inhaled by users is defined as an upper part of the electronic cigarette, while the other end is defined as a lower part of the electronic cigarette. The electronic cigarette according to the present disclosure makes full use of the internal space and thus enlarges the liquid storage space and improves user experience.

Figure 5:
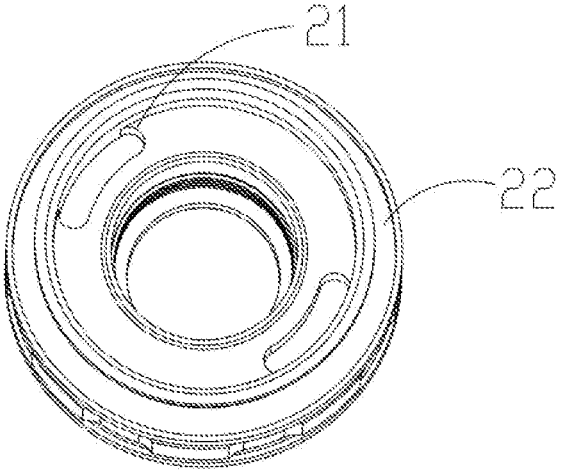
FIG. 5 is a diagram of a closed state of the liquid-flow regulating assembly shown in FIG. 4.
Figure 6:
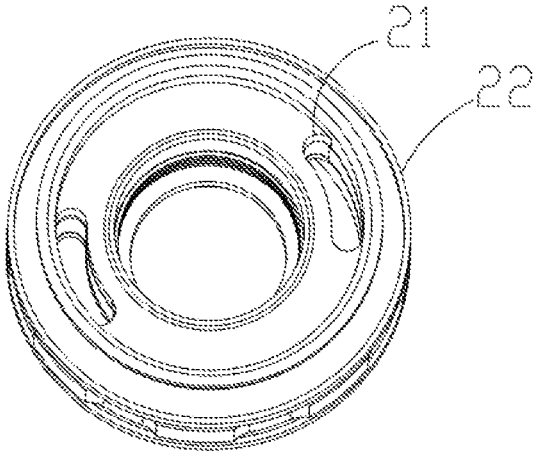
FIG. 6 is a diagram of an open state of the liquid-flow regulating assembly shown in FIG. 4.

In the present embodiment, the internal structure of the electronic cigarette is designed as a bilayer tobacco liquid storing structure. The bilayer tobacco liquid storing structure includes a first liquid storage chamber 30 and a second liquid storage chamber 40, and further includes a liquid-flow regulating assembly 20. The liquid-flow regulating assembly 20 is configured for switching the communicating state and the closed state between the first liquid storage chamber 30 and the second liquid storage chamber 40. After the liquid in the second liquid storage chamber 40 is used up, the liquid-flow regulating assembly 20 can be operated to switch the original closed state between the first liquid storage chamber 30 and the second liquid storage chamber 40 into the communicating state, so that the liquid in the first liquid storage chamber 30 can flow into the second liquid storage chamber 40 for the electronic cigarette to use. FIG. 5 and FIG. 6 are diagrams of the liquid-flow regulating assembly in different states. With such structure, the internal space of the electronic cigarette can be fully used, the liquid storage space of the electronic cigarette can be enlarged and the user experience can be improved.

Further, the liquid-flow regulating assembly 20 in the present embodiment includes a threaded ring 22, an internal thread 27 and a liquid-flow regulating ring 25. The threaded ring 22 is configured to be matched and connected with the internal thread 27 so as to secure the liquid-flow regulating ring 25 between the threaded ring 22 and the internal thread 27. The present embodiment secures the liquid-flow regulating ring 25 by way of making the threaded ring 22 and the internal thread 27 pressed against each other and secured to each other, thereby making the threaded ring 22, the internal thread 27 and the liquid-flow regulating ring 25 secured together. The assembly is convenient. The disassembly and installation are easy. It should be noted that, when the liquid-flow regulating ring 25 is secured between the internal thread and the threaded ring, the liquid-flow regulating ring 25 is capable of rotating.

Figure 4:
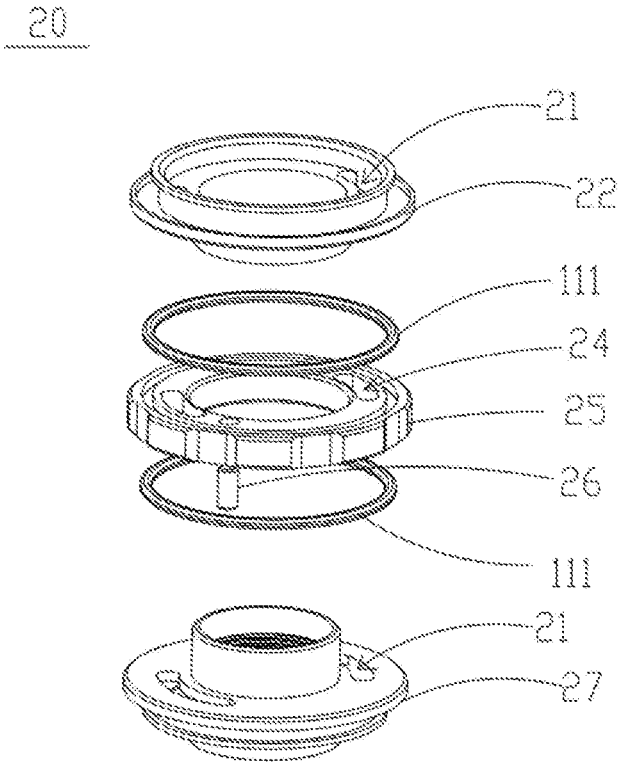
FIG. 4 is an exploded view of a liquid-flow regulating assembly shown in FIG. 2.

In order to enable the communication between the first liquid storage chamber 30 and the second liquid storage chamber 40, the liquid-flow regulating ring defines two first through holes 24, the two first through holes 24 being distributed symmetrically along a central axis of the liquid-flow regulating ring 25; and the internal thread 27 and the threaded ring 22 define a second through hole 21 fitting the first through hole 24. Referring to FIG. 4 to FIG. 6, when the liquid in the second liquid storage chamber 40 is used up, the liquid-flow regulating ring 25 is rotated so that the first through hole 24 on the liquid-flow regulating ring 25 is rotated to a position corresponding to the second through hole 21; then, the first liquid storage chamber 30 and the second liquid storage chamber 40 are in communication, and the liquid in the first liquid storage chamber 30 flows into the second liquid storage chamber 40 along the first through hole 24 and the second through hole 21. The present embodiment achieves the communication between the first liquid storage chamber 30 and the second liquid storage chamber 40 by defining the first through hole 24 and the second through hole 21 that fit each other. The use is convenient.

Further, in order to realize precise location when rotating the liquid-flow regulating ring, the liquid-flow regulating assembly further includes a pin 26. The pin 26 is configured to be installed at a position close to the first through hole 24. Preferably, the liquid-flow regulating assembly 20 further includes a sealing ring 111. During assembly, first, the sealing ring 111 is installed in a corresponding groove of the liquid-flow regulating ring; then, the pin 26 is pressed on a bottom surface of the liquid-flow regulating ring 25 close to the internal thread 27; and finally, the top and bottom of the liquid-flow regulating ring 25 are secured to the threaded ring 22 and the internal thread 27 respectively, as the threaded ring 22 and the internal thread 27 press against each other. Thus, the assembly of the liquid-flow regulating assembly 20 is completed. During use, the pin 26 can realize the precise location of the liquid-flow regulating ring 25 in the rotating process of the liquid-flow regulating ring 25.

Further, the upper cover assembly includes a mouthpiece 11, an upper cover 13 and a fixing part 14. The upper cover 13 is configured to be connected to the fixing part 14. The mouthpiece 11 is configured to be in thread connection with the upper cover 13. The fixing part 14 defines two first air inlets 12, the two first air inlets 12 being distributed symmetrically along a central axis of the fixing part 14. In the present embodiment, the upper cover 13 and the mouthpiece 11 are in detachable thread connection, so as to facilitate installation and liquid refill. In the present embodiment, the first air inlets 12 are opened on the fixing part, which indicates that air enters from the top of the electronic cigarette.

Further, the upper cover assembly further includes an airflow regulating ring 15. The airflow regulating ring 15 has an outer circumferential surface defining two second air inlets 16, the two second air inlets 16 being distributed symmetrically along a central axis of the airflow regulating ring 15. The airflow regulating ring 15 is configured to be sleeved on the fixing part 14. In the present embodiment, the second air inlet 16 and the first air inlet 12 have the same size and shape and fit each other. Since the airflow regulating ring 15 is sleeved on the fixing part 14, the airflow regulating ring 15 can be operated to regulate the size of the overlap of the first air inlet 12 and the second air inlet 16, thereby regulating the airflow entering the interior of the electronic cigarette. With such structure, the airflow rate can be regulated effectively, and the use is very convenient. In the present embodiment, the upper cover assembly further includes an airflow blocking sheet. The airflow blocking piece is configured to be disposed on a lower end of the upper cover and is configured for sealing airflow when pressed by the upper cover.

Further, the first liquid storage chamber 30 includes an atomizer assembly 32 and a first casing 31. The atomizer assembly 32 has one end connected to the internal thread 27 and the other end connected to the fixing part 14. The first casing 31 is configured to be sleeved on the atomizer assembly 32. During the installation process, the atomizer assembly 32 is fixed on the internal thread 27 through thread connection, then the first casing 31 is installed on the threaded ring 22, and finally the fixing part 14 is fixed with the atomizer assembly 32 through thread connection.

Further, the second liquid storage chamber 40 includes a support 42 and a second casing 41. The support 42 is configured to be connected to the internal thread 27. The second casing 41 is configured to be sleeved on the support 42. The lower cover assembly includes a lower cover 43, a contact part 114 and an insulating ring 113. During the installation process, the support 42 is fixed on the lower cover 43, then the second casing 41 is installed on the lower cover 43, next the support 42 is fixedly connected to the internal thread 27 through thread connection, and finally the second casing 41 is fixed. Further, a flat washer 112 is disposed between the support 42 and the lower cover, to protect parts and reduce damage. When the electronic cigarette is assembled as an integral part, both the support 42 and the lower cover 43 have an insulating ring 113 installed therein, and the contact part 114 passes through the insulating ring 113 to be assembled with the lower cover 43 and the support 42. This part is a common structure of electronic cigarettes, and no further description is needed here.

The cooperated use of the first liquid storage chamber 30 and the second liquid storage chamber 40 improves the utilization of the internal space of the electronic cigarette to a great extent, enlarges the liquid storage space of the electronic cigarette, and prolongs the usage time of the electronic cigarette.

It should be noted that both sealing ring 111 and flat washer 112 are disposed between each of the above parts when assembling, so as to ensure the sealability of the whole electronic cigarette and the firmness between each part. Specific conditions can be designed according to actual structures.

The present disclosure further provides an electronic cigarette. The electronic cigarette includes the bilayer tobacco liquid storing structure described above. Since the electronic cigarette of the present embodiment employs all technical schemes of all embodiments above, the electronic cigarette at least has all beneficial effects brought by the technical schemes of the above embodiments. No further description is needed here.

The above are preferred embodiments of the present disclosure merely and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. A bilayer tobacco liquid storing structure for an electronic cigarette, comprising an upper cover assembly, a lower cover assembly, a liquid-flow regulating assembly, a first liquid storage chamber and a second liquid storage chamber, the upper cover assembly being connected to one end of the first liquid storage chamber, the liquid-flow regulating assembly having two ends connected to the first liquid storage chamber and the second liquid storage chamber respectively, the lower cover assembly being connected to the second liquid storage chamber, wherein the liquid-flow regulating assembly comprises a threaded ring, an internal thread and a liquid-flow regulating ring; and the threaded ring is configured to be matched and connected with the internal thread so as to secure the liquid-flow regulating ring between the threaded ring and the internal thread.

2. The bilayer tobacco liquid storing structure for an electronic cigarette according to claim 1, wherein the liquid-flow regulating ring defines two first through holes, the two first through holes being distributed symmetrically along a central axis of the liquid-flow regulating ring; and the internal thread and the threaded ring define a second through hole fitting the first through hole.

3. The bilayer tobacco liquid storing structure for an electronic cigarette according to claim 2, wherein the liquid-flow regulating assembly further comprises a pin; and the pin is configured to be installed at a position close to the first through hole.

4. The bilayer tobacco liquid storing structure for an electronic cigarette according to claim 1, wherein the second liquid storage chamber comprises a support and a second casing; the support is configured to be connected to the internal thread; and the second casing is configured to be sleeved on the support.

5. The bilayer tobacco liquid storing structure for an electronic cigarette according to claim 1, wherein the liquid-flow regulating assembly further comprises a sealing ring; and the sealing ring is configured to be installed between the liquid-flow regulating ring and the internal thread.

6. The bilayer tobacco liquid storing structure for an electronic cigarette according to claim 1, wherein the upper cover assembly comprises a mouthpiece, an upper cover and a fixing part; the upper cover is configured to be connected to the fixing part; the mouthpiece is configured to be in thread connection with the upper cover; and the fixing part defines two first air inlets, the two first air inlets being distributed symmetrically along a central axis of the fixing part.

7. The bilayer tobacco liquid storing structure for an electronic cigarette according to claim 6, wherein the upper cover assembly further comprises an airflow regulating ring; the airflow regulating ring has an outer circumferential surface defining two second air inlets, the two second air inlets being distributed symmetrically along a central axis of the airflow regulating ring; and the airflow regulating ring is configured to be sleeved on the fixing part.

8. The bilayer tobacco liquid storing structure for an electronic cigarette according to claim 6, wherein the first liquid storage chamber comprises an atomizer assembly and a first casing; the atomizer assembly has one end connected to the internal thread and the other end connected to the fixing part; and the first casing is configured to be sleeved on the atomizer assembly.

9. An electronic cigarette, comprising the bilayer tobacco liquid storing structure according to claim 1.

* * * * *